United States Patent [19]

Schenk

[11] 4,117,928

[45] Oct. 3, 1978

[54] FASTENER FOR SHIPPING CONTAINER

[75] Inventor: Peter Schenk, West Islip, N.Y.

[73] Assignee: Dzus Fastener Co. Inc., West Islip, N.Y.

[21] Appl. No.: 790,280

[22] Filed: Apr. 25, 1977

[51] Int. Cl.[2] ..... B65D 85/00; A44B 21/00

[52] U.S. Cl. ..... 206/320; 24/221 R; 26/326

[58] Field of Search ..... 24/221 R, 221 A, 221 K, 24/221 RC; 206/320; 248/119 R; 206/326

[56] References Cited

U.S. PATENT DOCUMENTS

| | | | |
|---|---|---|---|
| 260,719 | 7/1882 | Westwood | 24/221 R |
| 2,459,879 | 1/1949 | Hardwick | 206/320 |
| 3,198,324 | 8/1965 | Kallenbach et al. | 248/119 R |
| 3,675,280 | 7/1972 | Winslade | 24/221 K |

*Primary Examiner*—Kenneth J. Dorner

*Attorney, Agent, or Firm*—Kane, Dalsimer, Kane, Sullivan & Kurucz

[57] ABSTRACT

A quick release fastener for mounting an article in a protective shipping container. The fastener includes a stud having a base portion with means thereon for mounting the stud to the article being protected and a head portion extending from the base. The fastener includes a receptacle having a larger diameter flange thereon for interengagement with surfaces on the shipping container and a tubular housing with a recess therein for receipt of the head of the stud therein. One of the stud in the receptacle has a spiral cam slot therein and the other of the stud and receptacle has a cam follower thereon for interengagement therebetween when the stud is mounted to the article and the receptacle is positioned on the container. A spring is provided for permitting relative rotation between the stud and receptacle to the fastened position to hold the article in fixed position in the container and to the unfastened position to permit removal of the article from the container.

7 Claims, 19 Drawing Figures

FIG. 1A
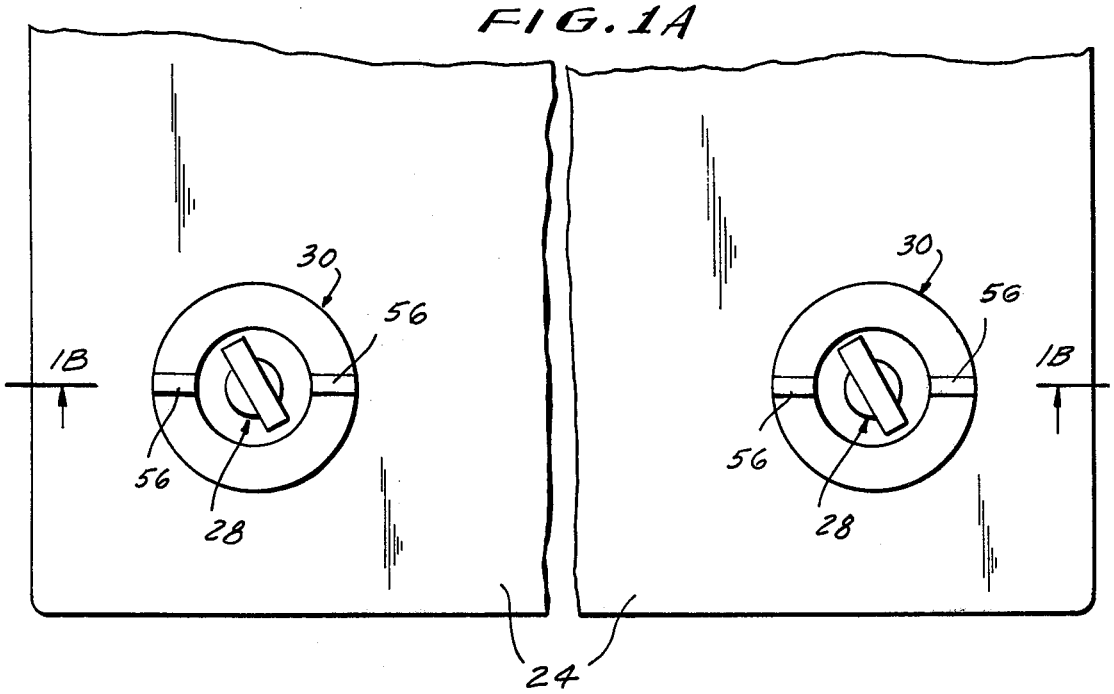
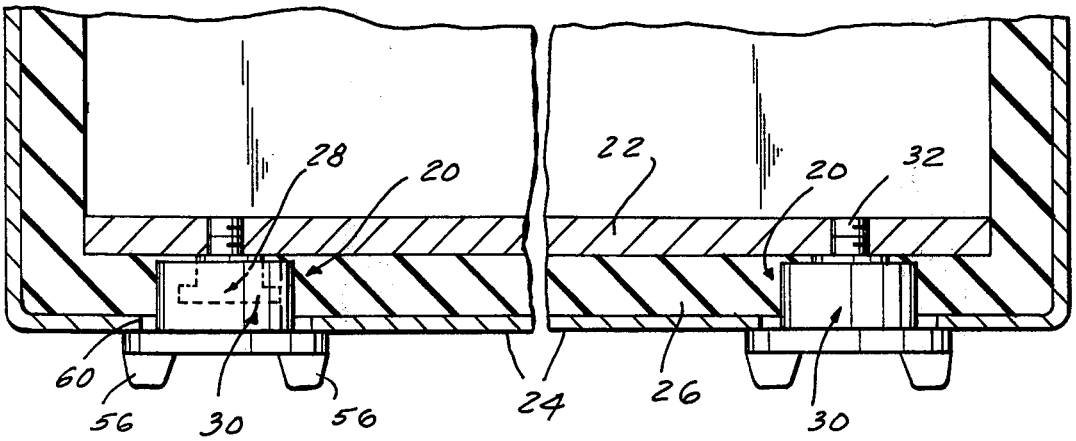
FIG. 1B

FASTENER FOR SHIPPING CONTAINER

BACKGROUND OF THE INVENTION

Many different types of articles are shipped in fixed and protected position within a container. In fact, often the articles are covered with insulation, particularly resilient insulation surrounding and protecting the article from the walls of the container. Naturally this is true for many diverse types of items. A common type of article under consideration would be one which contains frangible or fragile component parts and might be subjected to breakage or other damage from contact with walls of the container or from forces exerted from the exterior of the container.

One way of mounting this type of article is to extend screws or bolts through appropriate apertures in the container and a portion of the article or supporting structure for the article so that the article is screwed or bolted in position within the container. Mounting and dismounting of the article in this fashion is time consuming. In todays cost conscience economy, the saving of time is a financial saving as well. Therefore, improvements in the manner in which the article is packed in fixed and protected position within a container and unpacked thereafter which are directed to speed and efficiency are extremely desirable.

It should also be kept in mind that screws and bolts also can present alignment problems between the fastening means, the article and the container. The procedure can be difficult and cumbersome due to the presence of blind holes and inaccessible locations. Accordingly, a fastener which can be easily and quickly assembled and disassembled in difficult and blind locations would naturally also be advantageous.

Furthermore, it is necessary in the prevelent system in use today to fasten and unfasten each fastener independently. Once again time is a factor and accordingly, it would be an advantage to provide a fastener assembly which can be interconnected with other similar fastener assembly so that a plurality of assemblies can be fastened and unfastened simultaneously thus providing mounting points for the article at a number of locations which can be released together so that the article can be quickly and easily mounted and removed from the protective shipping container.

In the fastening environment, it is also of concern that the minimum number of parts be utilized for a fastener assembly to minimize the manufacturing and assembly costs.

SUMMARY OF THE INVENTION

With the above background in mind, it is among the objectives of the present invention to provide a fastener assembly which can be utilized to mount an article within a protective shipping container in a quick and efficient manner, is of low cost construction, and is adapted for ease of operation either independently or simultaneously as a plurality of fasteners.

An objective is to provide a fastener which is designed for shifting between the coupling and uncoupling position with approximately a one quarter turn rotation.

The fastener of the present invention is designed for use with existing protective shipping containers particularly those which employ a resilient insulation to protect an article therein so that the insulation can be used as a spring member to cooperate in permitting the fastener elements to be shifted between the fastened and unfastened positions with a small relative rotational movement between the elements of the fastener.

It is an objective of the present invention to provide a fastener assembly with a two piece design wherein one piece is a stud member adapted to be mounted to the article within the shipping container and the second piece acts as a receptacle for engagement with the exterior of the container and to extend through an aperture therein for coupling with the stud. Rotation of the receptacle portion on the exterior of the container will couple the receptacle to the stud within the container and capture the article with a flange engaging with the outer surface of the container.

A further objective of the present invention is to provide a receptacle with indexing means thereon so that it can be quickly and efficiently mounted to the article and the container to hold the article in position with a stud portion of the fastener being indexed for proper coupling position with a receptacle portion to hold the article to the container.

The assembly is designed for the coupling and uncoupling action of a cam follower and a spiral cam slot with the follower on the one portion of the fastener and the slot on the other. The spring resiliency utilized to permit axial movement of the follower with respect to the spiral cam slot between the fastening and unfastening position is provided by the resilient insulation material within the container protecting the article therein.

A further objective of the present invention is to provide a fastener assembly with a stud and receptacle portion with the stud adapted to be screw mounted to the article being fastened in position for engagement with the receptacle coupled with the container so that the coupling of the stud and receptacle will mount the article in fixed position within the container.

A still further objective of the present invention is to provide a fastener assembly employing a stud portion and a receptacle portion with the stud and receptacle initially being formed as one piece and adapted to be inserted partially within an aperture in the container to position the stud for mounting the stud to the article within the container. The point of interconnection between the receptacle and stud is a weakened zone which permits detachment of the receptacle and the stud and realignment therebetween so that relative rotation will fasten the receptacle to the stud and hold the article in fixed position in the container.

Another further objective of the present invention is to provide a fastener assembly employing both a stud and a receptacle with the stud adapted to be mounted to an article within the container and the receptacle adapted to be inserted through an aperture in the container to couple with the stud and having a flange portion positioned for engagement with the exterior of the container so that interengagement between the receptacle and the stud will mount the article in fixed position within the container. The flange of the receptacle is spaced from adjacent receptacles of adjacent fasteners and a tie bar interconnects each adjacent pair of receptacles. A latch handle is mounted on the flange of one receptacle so that activation of the latch handle will rotate the one receptacle and all interconnected receptacles simultaneously through movement of the tie bars to shift simultaneously all of the interconnected receptacles between the fastened and unfastened positions thereby facilitating quick and efficient mounting and dismounting of the article within the container.

In summary, a quick release fastener is provided for mounting an article in a protective shipping container. The fastener includes a stud having a base portion with means thereon for mounting the stud to the article being protected and a head portion extending from the base. The fastener includes a receptacle having a larger diameter flange thereon for interengagement with surfaces on the shipping container and a tubular housing with a recess therein for receipt of the head of the stud therein. One of the stud and receptacle has a spiral cam slot thereon and the other of the stud and receptacle has a cam follower thereon for interengagement therebetween when the stud is mounted to the article and the receptacle is positioned on the container. Finally, spring means is provided for permitting relative rotation between the stud and receptacle to the fastened position to hold the article in fixed position in the container and to the unfastened position to permit removal of the article from the container.

With the above objectives among others in mind, reference is made to the attached drawings.

BRIEF DESCRIPTION OF THE DRAWINGS

In the drawings:

FIG. 1A is a fragmentary bottom view of a shipping container depicting two of the fasteners of the invention holding an article in fixed position within the container;

FIG. 1B is a fragmentary sectional elevation view thereof taken along the plane of line 1B—1B of FIG. 1A;

DESCRIPTION OF THE PREFERRED EMBODIMENTS

Figure 2:
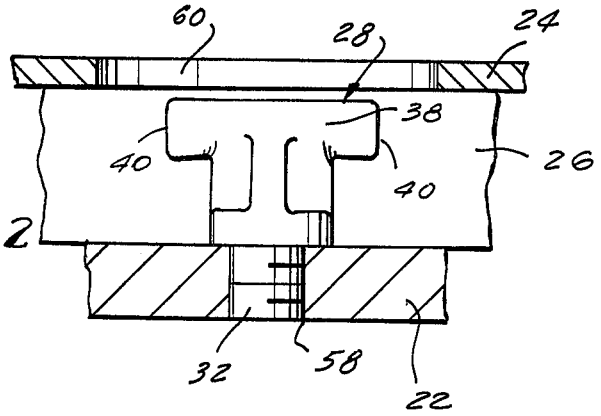
FIG. 2 is an enlarged fragmentary sectional elevation view thereof showing the stud portion of a fastener of the invention mounted in position.

As shown in FIGS. 1A and 1B each fastener 20 is adapted for use in holding an article 22 in fixed position within a conventional type of shipping container 24. The container depicted employs an insulation material 26 between the article and the walls of the container 24. The insulation material is formed of a conventional resilient protective material such as natural or synthetic rubber or plastic foam material.

Fasteners 20 are designed for quick coupling with the article to hold in position within the container and for quick release to permit removal of the article 22 after the container 24 is opened.

The number of fasteners 20 employed depends on the size of the container and article being housed in the container. Each fastener 20 includes a stud portion 28 and a receptacle portion 30.

Figure 8:
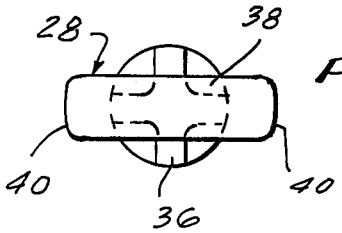
FIG. 8 is a top plan view of the stud portion of the fastener of the invention.
Figure 9:
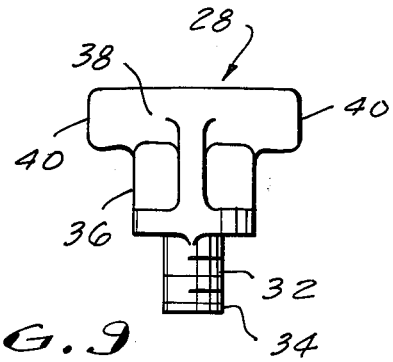
FIG. 9 is a side elevation view thereof.
Figure 10:
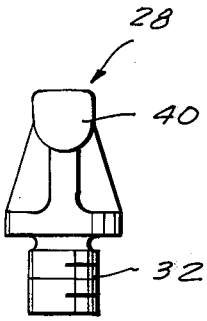
FIG. 10 is an end elevation view thereof.

The stud portion 28 is depicted alone in FIGS. 8–10 of the drawings. The stud is formed with a cylindrical base 32 having a threaded outer surface 34 for assembly with the article to be held in position and a head 36 extending from one end of the base 32. A lateral cross bar 38 is formed on the end of head 36 distal from base end 32. The cross bar is positioned so that a pair of lateral projections 40 extend outwardly from the stud and form a cam follower for engagement with surfaces on the receptacle.

Figure 5:
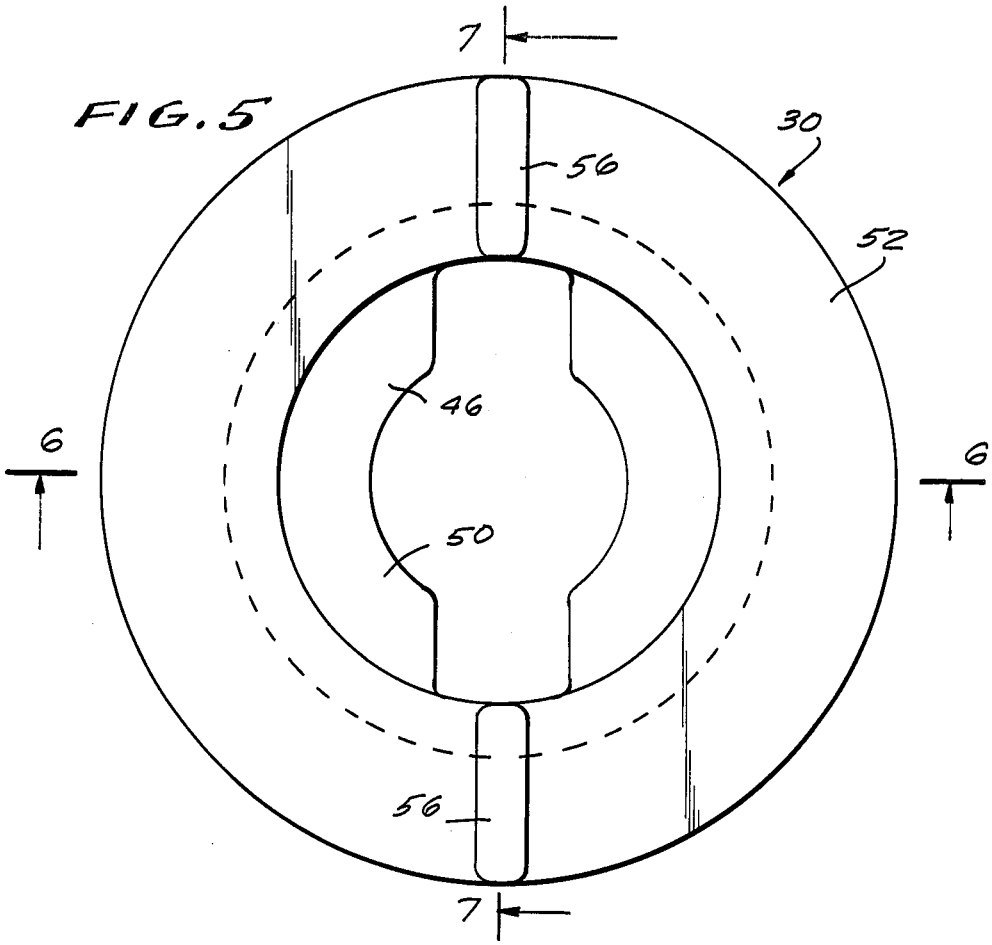
FIG. 5 is an enlarged top plan view of the receptacle portion of the fastener of the invention.
Figure 6:
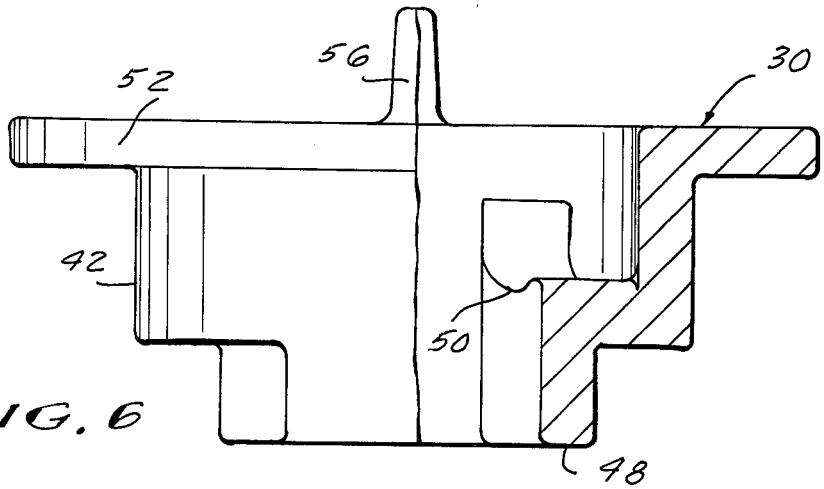
FIG. 6 is an enlarged sectional view thereof taken along the plane of line 6—6 of FIG. 5.
Figure 7:
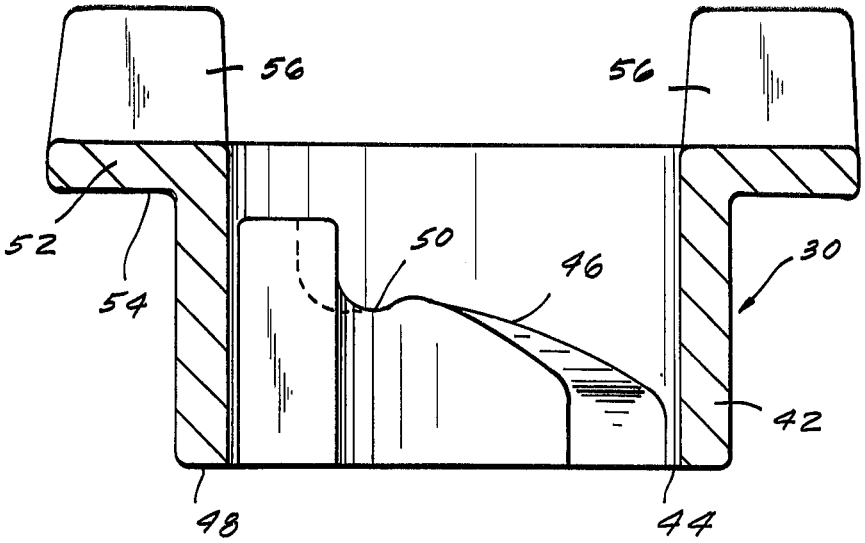
FIG. 7 is an enlarged sectional view thereof taken along the plane of line 7—7 of FIG. 5.

Receptacle 30, depicted along in FIGS. 5–7, includes a tubular housing portion 42 having an opening 34 at one end for receipt of the cam follower portion 40 of the stud therethrough. A helical surface 46 is formed on the interior surface of tubular housing 42 to provide a spiral cam slot for travel of the cam follower 40. As depicted, the cam slot 46 has a predetermined travel length extending from the bottom edge 48 of housing 42 to a locking detent 50. The travel length is chosen so that a minimum desired amount of rotation is required for assembly and disassembly of the stud and receptacle. In the embodiment shown, a travel length of 120° of rotation is sufficient to couple and uncouple the fastener assembly 20. This is a traditional type of spiral cam slot and cam follower arrangement commonly known as a quarter turn fastener and the length of the spiral cam slot is usually chosen to be of a sufficient length to require only a 90°–120° rotation between the fastened and unfastened positions.

At the end of housing 42 opposite to end 44 is an annular laterally extending flange 52. The undersurface 54 of flange 52 forms a bearing surface in the locking action of fastener 20 as will be discussed in greater detail below. Extending upwardly from the uppersurface of flange 52 is a pair of gripping wings 56 which facilitate gripping and rotation of the receptacle in use.

The two parts of receptacle 20 are economically formed of a conventional low cost material which lends itself to mass production. An acceptable material is a conventional nylon or plastic which may be molded into the desired configuration.

Figure 3:
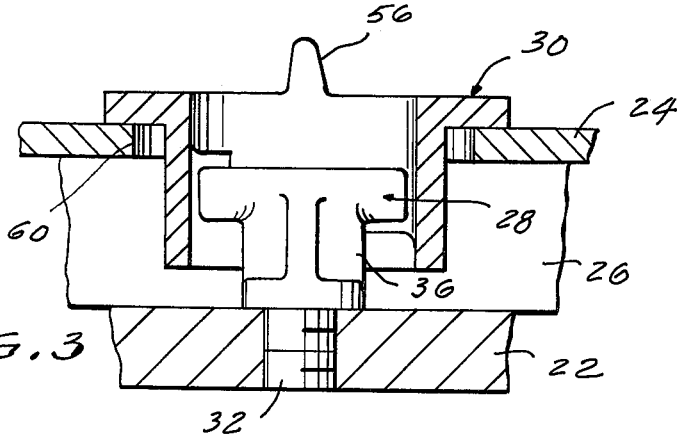
FIG. 3 is an enlarged fragmentary sectional elevation view thereof showing the receptacle portion in position for coupling with the sutd portion of the fastener of the invention.
Figure 4:
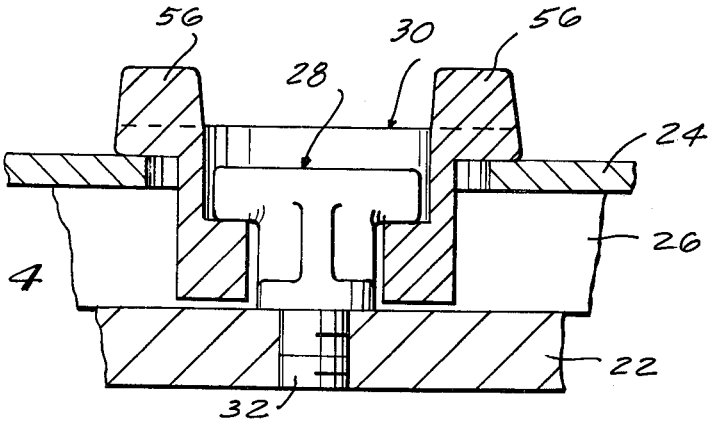
FIG. 4 is an enlarged fragmentary sectional elevation view of a shipping container showing the receptacle and stud portions of the fastener of the invention in coupled relationship.

The steps of assembly and use for fastener 20 is depicted in sequence in FIGS. 2–4. For each fastener 20, the article 22 is formed with a threaded aperture 58 which is adapted for positioning in alignment with a larger aperture 60 in container 24 as depicted, insulation material 26 is provided with appropriate passageways for portions of fastener 20.

The first step of assembly is to threadedly interengage threaded base 32 with the threaded receiving aperture 58 of article 22. As shown, when threaded in position, the head 36 extends outwardly from article 22 in alignment with aperture 60. The lateral projections 40 which form a cam follower are in position for coupling with receptacle 30.

Then, tubular housing 42 of receptacle 30 is inserted through larger opening 60 in container 24 in surrounding engagement with stud head 36. It is extended inwardly until the undersurface 54 of flange 52 engages with the adjacent exposed surface 62 of the container. Flange 52 has a larger diameter than aperture 60 for this purpose.

In this condition, the elements are as depicted in FIG. 3. Thereafter, as shown in FIG. 4, wings 56 are grasped and rotated approximately 90°–120° causing lateral projections to follow spiral cam slot 46 until they seat in locking detents 50 in the receptacle. The axial movement for this action is accommodated by the compression of the resilient insulation 26 surrounding the fastener parts between the container wall and the article. Thus, article 22 is fixed in protected position in container 24. To disassemble the container and release the article for removal, wings 56 are grasped and rotated in the opposite direction to cause lateral projections 40 to travel along spiral cam slot 46 until free for removal through open end 44 of tubular housing 42 of the receptacle. The biased resilient insulation 26 also assists in retaining the projection in the fastening position by exerting an axial force to hold the projection 40 in detent 50.

FIG. 11 shows a modification for fastener 20. A central axial passageway 62 is provided through stud head 64 which is the same shape and configuration as stud head 36 of the previous embodiment. A screw 66 is extended through the central axial passageway 62. The screw 66 is longer than the stud head 64 and has a threaded portion 68 extending beyond the bottom edge 70 of the stud head so as to function in the same manner as base 32 of the stud of the previous embodiment. The remainder of the shank is housed within passageway 62 and terminates in an enlarged head 72 which contains a slot 74 for engagement by an appropriate tool. The undersurface 76 of the head of screw 66 is serrated. For example, there can be 12 serrations spaced at 30° intervals about the circumference. The stud head is fastened to the article 22 by passing the shank of screw 66 through stud head 64 and into engagement with the threaded receiving aperture 58 of article 22. With an appropriate tool in slot 74 the screw 66 is threaded inwardly until the serrated undersurface 66 engages with the upper surface of stud head 64 thus mounting the stud head in fixed position on the article. The stud head is then in position for interengagement with receptacle 30 as in the previous embodiment and to operate in cooperation therewith in the same manner.

Figure 11A:
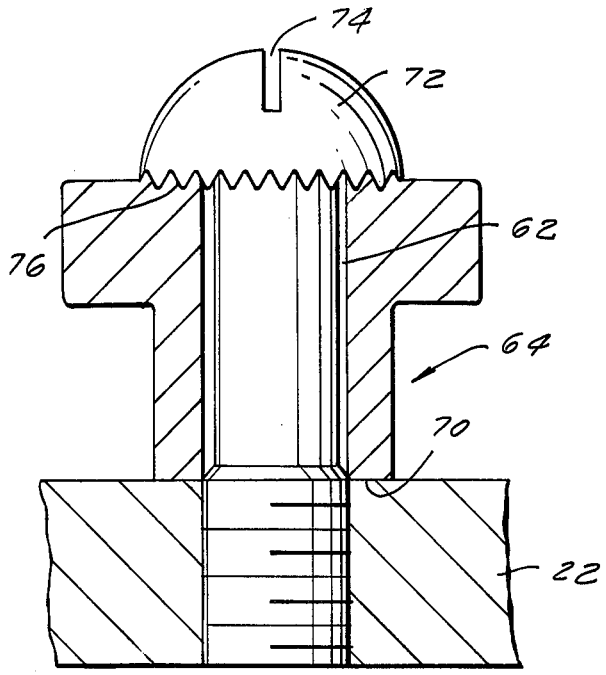
FIG. 11A is an enlarged fragmentary sectional view of an alternative form of stud portion of the invention mounted in position.
Figure 11B:
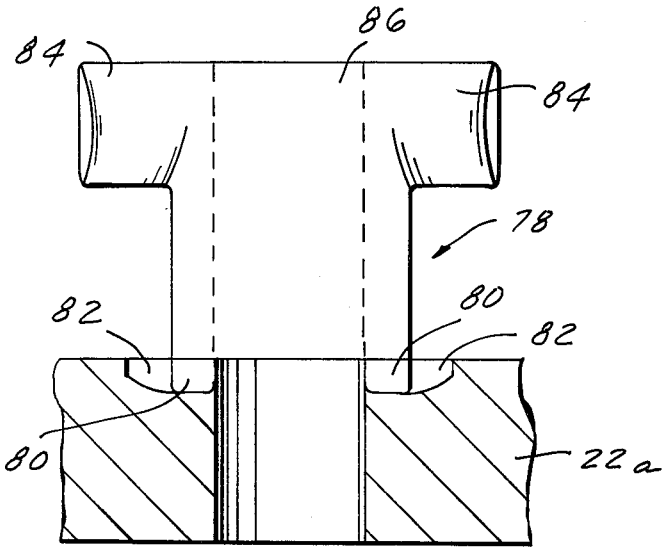
FIG. 11B is an enlarged fragmentary sectional view of a second alternative form of the stud portion of the invention.

A further modification is depicted in FIG. 11B where stud head 78 is identical to the stud head 64 of FIG. 11A with the exception of two downwardly extending tabs 80 projecting from the lower edge 70 of the stud head 78. These tabs are adapted for insertion in a pair of opposing receiving recesses 82 in the opposite surface of article 22*a* to provide for a means of indexing the stud head so that lateral projections 84, which act as the cam follower, are properly positioned for ease of coupling with receptacle 30. Stud head 78 is provided with a central passageway 86 for introduction of a screw 66 to be coupled with the threaded aperture 58 in article 22*a* in the same manner as the previously discussed embodiment. The number of indexing tabs 80 and accommodating recesses 82 is a matter of choice.

Figure 12:
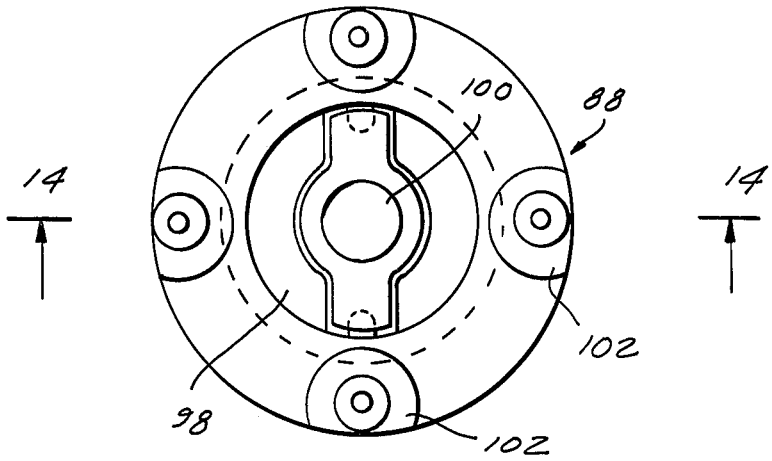
FIG. 12 is a top plan view of a third alternative form of the fastener of the invention.
Figure 13:
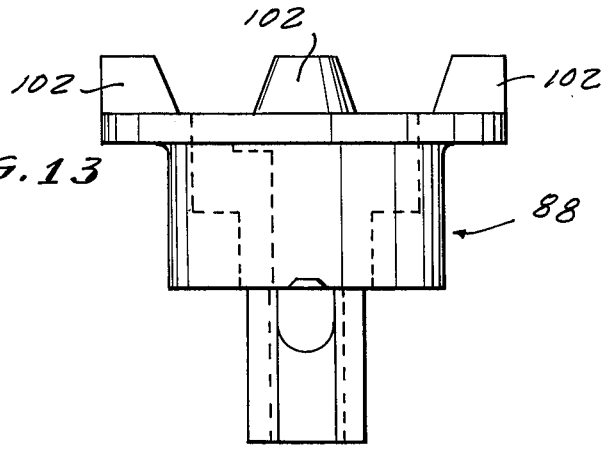
FIG. 13 is a side elevation view thereof.
Figure 14:
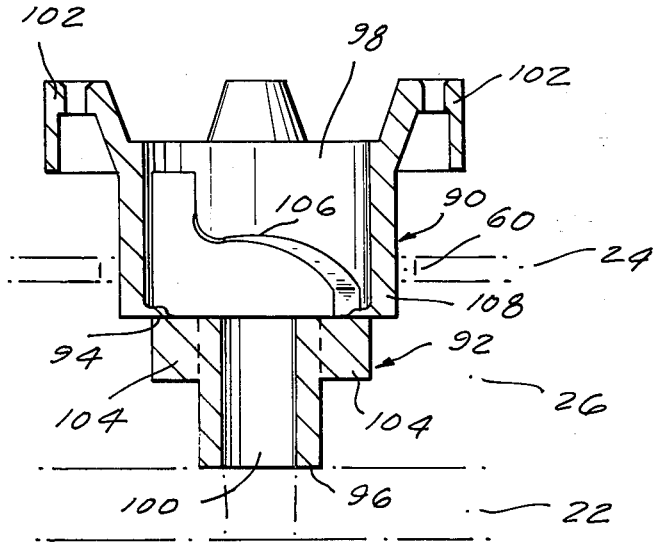
FIG. 14 is a sectional elevation view thereof showing the fastener in position for mounting purposes.

A further embodiment of the fastener of the invention is depicted in FIGS. 12–14. Fastener 88 is initially formed as a one piece member with receptacle portion 90 interconnected with stud portion 92 by a weakened integral zone 94. Thus, the receptacle and stud can be introduced as a unit through aperture 60 in container 24 until the undersurface 96 of stud head 92 engages with the surface of article 22. In the depicted embodiment, an appropriate screw 66 is then passed through the open center 98 of receptacle 90 and then through passageway 100 in stud head 92 to be coupled with the threaded receiving recess in article 22 to fastened the stud head in position in the same manner as in previously discussed embodiments. Naturally, alternatively, in place of the screw, the stud head could be integrally formed with a threaded base portion as with the first discussed embodiment.

Thereafter, receptacle wings or ears 102 are grasped and the receptacle 90 is rotated relative to fixed stud head 92. This causes fracture at the zones of weakness 94 so that receptacle 90 is free from interconnection with stud head 92. The receptacle can then be lowered further through aperture 60 until lateral projections 104 forming the cam follower come into engagement with helical slot 106 in the side walls of the tubular housing portion 108 of receptacle 90. Thereafter, the same quarter turn rotation is all that is required to fully couple the receptacle with the stud as in the previous embodiments with resilient insulation material 26 providing the necessary axial spring action for the coupling action. In this manner container 24 is coupled with article 22 which is held in fixed protective position therein. Uncoupling is accomplished in the same manner by merely rotating the receptacle in the opposite direction a quarter turn and removing the receptacle from the stud head 92 thus freeing article 22 from interconnection with container 24.

Figure 15:
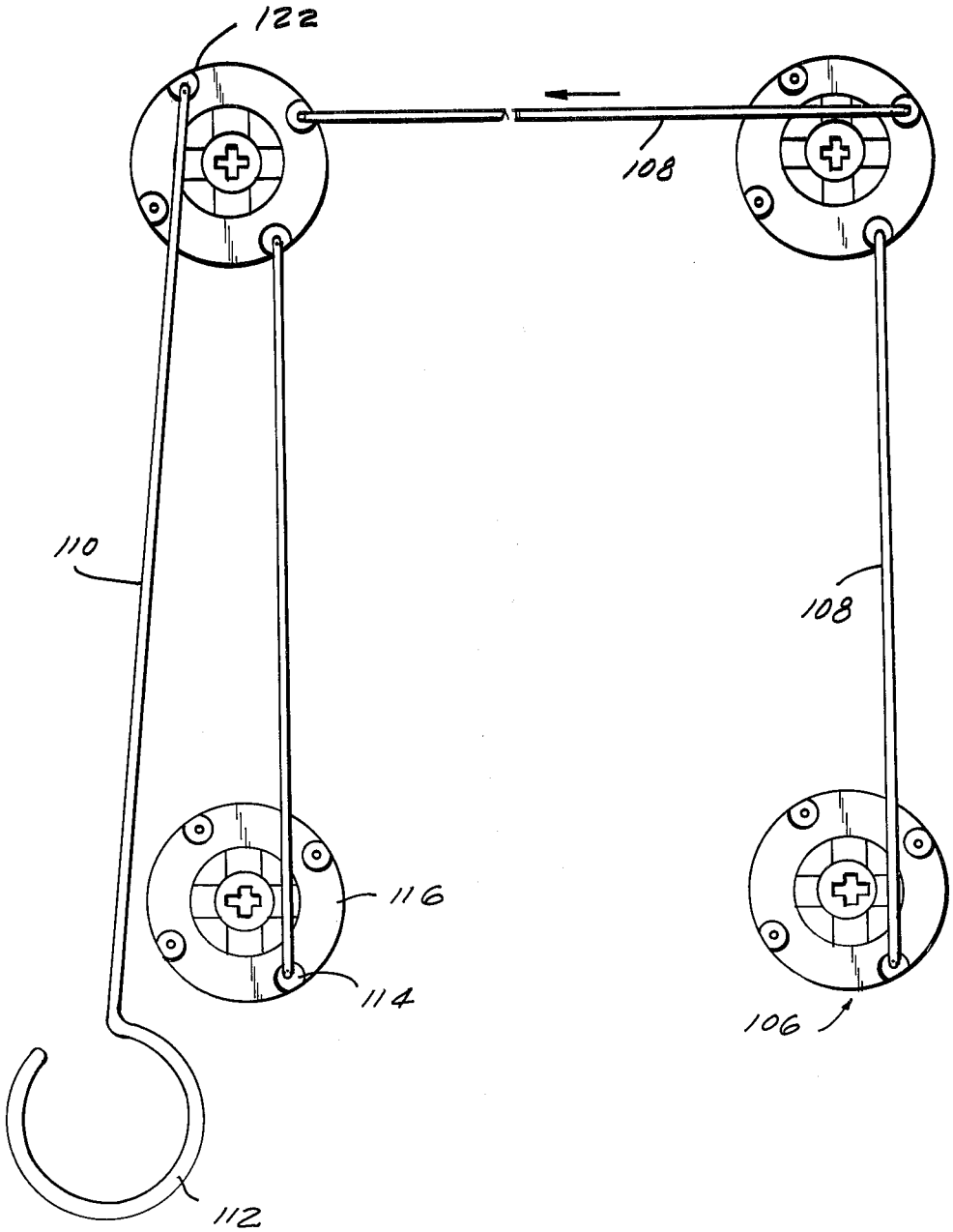
FIG. 15 is a plan view of a fourth alternative embodiment of the fastener of the present invention showing a plurality of fasteners interconnected for simultaneous operation.
Figure 16:
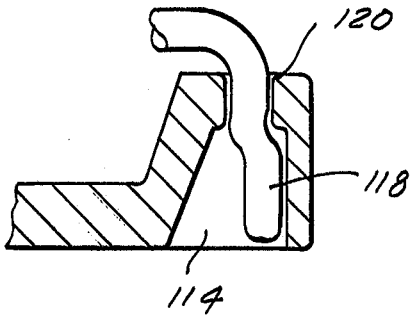
FIG. 16 is a fragmentary sectional elevation view of a part of a receptacle portion thereof.
Figure 17:
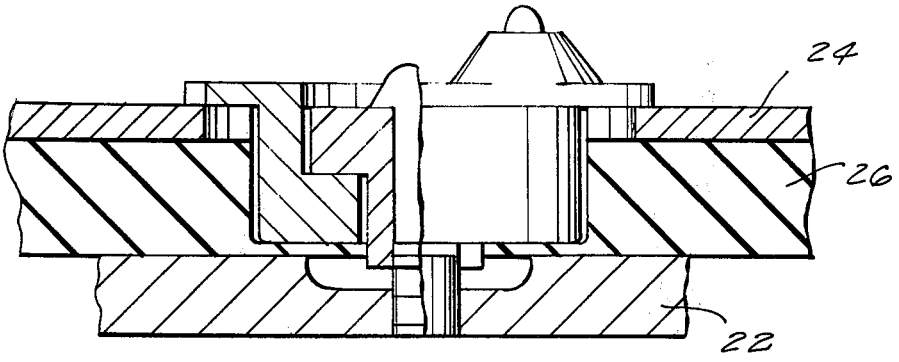
FIG. 17 is a fragmentary sectional side elevation view thereof showing the fastener mounted in position.

A further embodiment is depicted in FIGS. 15–17. In this embodiment, a plurality of fasteners 106 are interconnected by tie bars or rods 108. Furthermore, an actuation handle 110 is fastened to one of the fasteners 106 and the actuation handle or lever 110 has a free, hooked end 112 which can be grasped and pulled or pushed thus rotating simultaneously all of the interconnected receptacle portions of the fasteners and unfastening or fastening the fasteners respectively. In this manner, it is possible to simultaneously unfasten or fasten a plurality of fasteners and thus speed up the fastening and unfastening process in packing and unpacking the articles.

To facilitate the desired rotational action, the end of each tie rod 108 is captured in an offset receiving recess 114 in the flange 116 of the receptacle which is exposed above the outer surface of container 24. The interconnection in this respect is depicted in FIG. 16 where the bent end 118 is captured in recess 114 by threading it through small aperture 120. There is sufficient clearance for the end 118 to rotate but due to the curved shape of end 118 it is restricted from axial removal from receptacle flange 116 with sufficient interference being provided. All of the tie rods 108 are fastened to a pair of adjacent receptacles in the same manner so that they can rotate simultaneously. Similarly, the end of handle 110 is also fastened in the same manner so that rotation caused by a force applied to handle 112 and transmitted through its interconnection in offset recess 122 of a receptacle will cause rotation and shift all of the interconnected receptacles the desired rotational amount to achieve the desired unfastening and fastening effect in the same manner as accomplished in respect to the above discussed embodiments. The remaining construction of fasteners 106 can be identical to that described in connection with any of the above discussed embodiments. To assure that the action of rotational movement caused by actuation of handle 112 will simultaneously release or fasten all of the fasteners, it is desirable to first index the stud in position such as by use of the tabs 80 depicted in FIG. 11B. In this manner, it is predetermined that the projections on the stud forming the cam follower are all aligned.

Thus, for installation of the embodiment of FIGS. 15–17, the stud is first indexed and fastened in position to article 22. Each receptacle is then mounted to the stud and shifted to the fastened position. The tie links 108 are then snapped into the appropriate offset receiving recesses 114 to form the interconnection. In the fastened position as shown in FIG. 15, all the tie links and tie rods 108 are in tension with the tips being offset to retain them in the offset position in the receptacle heads. Unfastening is then accomplished by a mere pull on free handle 110. Once again, a quarter turn of from 90 to 120 degrees is all that is required for shifting to the unlocked position.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. In a shipping container of the type having a surrounding peripheral wall and a hollow interior for retaining an article therein, resilient protective insulation in the container and located between the article and at least one adjacent portion of the inner surface of the peripheral wall of the container, the improvement comprising; a quick release fastener for mounting the article in the protective shipping container and including a stud having a base portion with means thereon for mounting the stud to the article being protected and a head portion extending from the base, a receptacle having a larger diameter flange thereon for interengagement with surfaces on the shipping container and a tubular housing with a recess therein for receipt of the head of the stud therein, one of the stud and receptacle having a spiral cam slot thereon and the other of the stud and receptacle having a cam follower thereon for interengagement therebetween when the stud is mounted to the article and the receptacle is positioned on the container, the resilient protective insulation being positioned between the container and the article at least at the location of the fastener and acting as spring means to permit relative movement between the article and container toward and away from one another as the resilient spring means is compressed and released and thus permitting the shifting of the stud and receptacle between the fastened and unfastened positions.

2. The invention in accordance with claim 1 wherein the spiral cam slot is formed on the inner surface of the tubular housing portion of the receptacle and the cam follower is formed on the head portion of the stud.

3. The invention in accordance with claim 2 wherein the flanged portion of the receptacle includes an undersurface for engagement with the adjacent surface of the shipping container and finger gripping means in the form of at least one projection extending outwardly from the opposing surface of the flange to facilitate gripping and rotation of the receptacle when it is positioned on the shipping container with the tubular portion extending through an aperture in the shipping container in position for engagement with the head of the stud, the head of the stud being of substantially cylindrical configuration with a pair of diametrically opposed laterally extending prongs adjacent the edge of the head portion distal from the base portion, the outer diameter of the head portion being less than the diameter in the recess of the tubular housing for insertion therein with the lateral projections in engagement with the spiral cam slot.

4. The invention in accordance with claim 2 wherein the base portion of the stud is a threaded shank adapted for interengagement with a threaded receiving surface on the article to be mounted on the shipping container.

5. The invention in accordance with claim 2 wherein the spiral cam slot in the tubular housing terminates in a locking detent whereby rotation of the cam follower into alignment with the detent will permit it to be drawn therein by the resilient action of the insulation material.

6. The invention in accordance with claim 1 wherein the spiral cam slot has a predetermined length so that an approximate one quarter turn rotation of the stud and receptacle with respect to one another will shift the fastener between the fastened and unfastened positions.

7. The invention in accordance with claim 1 wherein the fastener is formed of nylon material.

* * * * *